United States Patent [19]

Algrim et al.

[11] Patent Number: 4,824,880

[45] Date of Patent: Apr. 25, 1989

[54] ASPHALT ADHESIVES

[75] Inventors: Donald J. Algrim, Reynoldsburg; William E. Uffner, Newark; Glenn D. Lamb, Granville; Stephen J. Jones, Newark, all of Ohio

[73] Assignee: Owens-Corning Fiberglas Corporation, Toledo, Ohio

[21] Appl. No.: 49,372

[22] Filed: May 14, 1987

Related U.S. Application Data

[62] Division of Ser. No. 835,581, Mar. 3, 1986, abandoned.

[51] Int. Cl.[4] ..... C08L 51/02; C08L 95/00

[52] U.S. Cl. ..... 524/62; 524/68; 524/71; 524/271; 524/509; 524/59; 428/57

[58] Field of Search ..... 524/68, 62, 71, 539, 524/271; 428/57

[56] References Cited

U.S. PATENT DOCUMENTS

| | | | |
|---|---|---|---|
| 3,138,897 | 6/1964 | McCorkle | 427/186 |
| 4,055,453 | 10/1977 | Tajma et al. | 428/291 |
| 4,196,115 | 9/1980 | Bresson | 524/68 |
| 4,217,259 | 9/1980 | Bresson | 524/68 |

*Primary Examiner*—Allan M. Lieberman

*Attorney, Agent, or Firm*—Patrick P. Pacella; Ted C. Gillespie

[57] ABSTRACT

An adhesive is provided for adhering roofing shingles wherein the adhesive is a blend of asphalt, an elastomer, a tackifying resin and a petroleum oil.

5 Claims, 3 Drawing Sheets

ASPHALT ADHESIVES

This is a division of application Ser. No. 835,581, filed Mar. 3, 1986, now abandoned.

TECHNICAL FIELD

The present invention is related to asphaltic compositions, and more particularly to an asphalt adhesive for retaining shingles. The adhesive is a blend of asphalt, an elastomer, a tackifying resin and a petroleum oil. The present invention also relates to a roofing sheet or shingle employing this elastomer-modified asphalt adhesive to retain the tabs of shingles against windlift.

BACKGROUND OF THE INVENTION

The use of adhesives, including asphaltic compounds, to provide a bond between roofing shingles when applied to a roof is known. During a typical shingle manufacturing process, a pattern of adhesive is applied to the headlap portion of the shingles so that the tab portion of the subsequently laid course of shingles on the roof will adhere to the headlap portion of the lower course, to help prevent wind uplift of the shingles. To seal properly, most adhesives or sealants require relatively high roof temperatures. U.S. Pat. No. 4,559,267 discloses an adhesive, of a compounded bitumen containing 3–20% rubber and/or thermoplastic resins, which requires an activation temperature of at least 90° F. Many other adhesives require roof temperatures of about 135° F. or higher. In relatively colder climates, these roof temperatures may never be reached or in certain climates, these temperatures may not be reached until seasons subsequent to installation, which may be months later. Consequently, under conditions where relatively low temperatures do not permit proper sealing of the adhesive, the shingles may be susceptible to blow-off in relatively higher winds. Another problem with conventional sealants is that colder temperatures tend to cause the sealant on properly sealed shingles to become brittle and crack, resulting in bond failures and blow-offs.

U.S. Pat. No. 3,138,897 to McCorkle addresses the blow-off problem by using an adhesive strip on the shingle composed of distinct bands of two different adhesives one is pressure sensitive while the other is temperature sensitive. As with conventional adhesives, the temperature sensitive adhesive of McCorkle seals at relatively higher temperatures and since it doesn't even begin to get tacky until about 70° F., a second adhesive must be used to permit sticking at lower temperatures, which is the pressure sensitive adhesive. The pressure sensitive adhesive is effective only at lower temperatures since it loses its tackiness beyond temperatures of about 100° F.

An asphalt-based adhesive has now been discovered which is both pressure and temperature sensitive and effectively works to greatly reduce the vulnerability of a shingle to the cold and wind. The adhesive of the instant invention remains tacky at roof temperatures as low as 50° F. to provide a good initial bond upon shingle installation at these temperatures. While the adhesive seals the shingles at temperatures required by most sealants, i.e., 135° F. or higher, this adhesive also effectively seals the shingles at roof temperatures as low as 50° F. This means that air temperature may be as low as 25° F. Additionally, the adhesive retains appreciable strength and flexibility at lower temperatures which means that the adhesive does not get brittle and crack and will not break an already formed seal.

A further advantage of having to apply only a single adhesive to the shingle is provided by the adhesive of the instant invention. The cost benefits of applying one sealant as opposed to two or more different sealants will become readily apparent to those skilled in the art, particularly when viewed from the standpoint of shingle manufacturing.

STATEMENT OF THE INVENTION

According to this invention, there is provided an adhesive composition, for retaining the tabs of shingles against windlift at temperatures of about 50° F. and greater, comprising a blend of asphalt, an elastomer, containing about 80% triblock styrene-butadiene-styrene copolymer and about 20% diblock styrene-butadiene copolymer, a tackifying resin, and a petroleum oil.

According to this invention, there is also provided an asphalt roofing sheet having applied on at least one surface the above-described adhesive compound, a contact surface and a release material. In the broadest sense of the invention, it encompasses any asphalt-based roofing sheet employing the above-described adhesive, where the roofing sheet is of the type designed to be laid down in courses or layers, with at least a portion of successive sheets overlapping.

DESCRIPTION OF THE INVENTION

Figure 1:
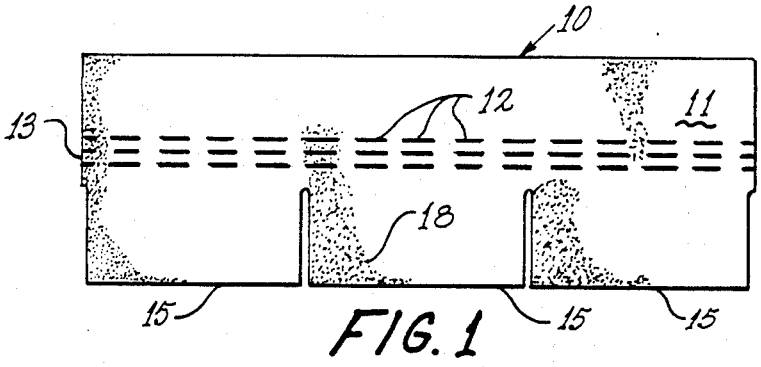
FIG. 1 is a plan view of the top side of a shingle with tab sealant adhesive.

The adhesive of the instant invention maintains sufficient tack at lower temperatures to provide a quick and good initial bond during installation and will seal shingles at roof temperatures as low as 50° F. when the air temperature may be as low as 25° F. Although the adhesive effectively seals at higher roof temperatures, it is especially useful for winter applications in colder northern climates and provides good resistance to blow-off.

The present adhesive uses an asphalt characterized by a kinematic viscosity in the range of from about 500 poise±100 to about 250±50 poise at 140° F. (60° C.) and a minimum viscosity of from about 110 cs (centistokes) to about 80 centistokes at 275° F. (135° C.). The asphalt can also be characterized by a penetration (ASTM D5 73) of from about 120 to about 300 dmm (deci millimeters) at 77° F. (25° C.). The asphalts of the instant invention exhibit a ring and ball softening point from about 90° F. to about 130° F.

Particularly good results were obtained with paving grade asphalts having a kinematic viscosity of about 500 poise±100 at 140° F. (60° C.), a minimum viscosity of about 110 cs at 275° F. (135° C.), a penetration of 120–175 dmm at 77° F. and a softening point from about 110° F. to about 120° F. These types of asphalts are known as viscosity-graded asphalt or AC-5 paving grade asphalt which is commercially available from Amoco Chemical Corporation (Chicago, Ill., U.S.A.).

Also useful is an AC-2.5 grade asphalt, also commercially available from Amoco, which has been mixed with oil to achieve a blend of about 90% AC-2.5 asphalt and 10% oil. A suitable oil is one characterized as a soft flux oil having a kinematic viscosity at 210° F. of about 60–90 cs which is commercially available from Marathon Oil Company (Findlay, Ohio, U.S.A.) and known as 432 oil. The asphalt blend is characterized by a softening point of about 100°–110° F., a penetration of from about 250–300 dmm at 77° F. and a viscosity of about 250±50 poise at 140° F.

The elastomers of the present invention are thermoplastic and selected for their ability to impart strength to the adhesive at colder temperatures. As with conventional thermoplastic organic polymers, these elastomers can be processed, i.e., melted and extruded, and can be repeatedly heated and cooled with no substantial loss in their properties, especially their elastomeric properties. Therefore, the elastomers employed herein substantially retain their properties when subjected to heating and cooling cycles. Particularly desirable is the retention of strength upon cooling the elastomer which gives strength and flexibility to the sealant at colder temperatures.

The elastomers employed in the present invention are block copolymers, usually triblock (A-B-A) and may be linear or radial in structure. Either block, A or B, may comprise more than one monomer. Preferred are those triblock copolymers having styrene or polystyrene as the "A" block or end block units. Suitable elastomers include thermoplastic rubbers of styrene-butadiene-styrene (S-B-S), styrene-isoprene-styrene (S-I-S) and styrene-ethylene-butylene-styrene (S-E-B-S) block copolymers. Preferred is a styrene-butadiene-styrene block copolymer, and especially one containing about 80% styrene-butadiene-styrene triblock copolymer and about 20% styrene-butadiene diblock copolymer. Suitable elastomers are commercially available from the Shell Chemical Company (Houston, Tex., U.S.A.) as Kraton® thermoplastic rubbers, Kraton D and Kraton G grades. Most preferred is Shell's Kraton D-1101 (S-B-S) rubber product which is a linear triblock copolymer containing about 80% triblock styrene-butadiene-styrene copolymer and about 20% diblock containing about 31% styrene and 69% butadiene, and which has a nominal molecular weight of about 100,000.

The tackifying resin can be any resinous material recognized in the art as enhancing the tack of the adhesive composition. Desirably, tackifiers will also impart cohesive strength or body to the adhesive so as to make it firm and not too soft. Suitable tackifying resins include rosin, rosin derivatives, polyterpene resins, thermoplastic phenolic resins, hydrogenated rosin esters of pentaerythritol, cumaroneindene and the like. Particularly good results were obtained using a modified hydrocarbon resin commercially available from the Neville Chemical Company (Pittsburgh, Pa., U.S.A.) known as Nevpene® 9500 Tackifying Resin. Other suitable tackifiers commercially available include terpene resins called Wingtack®, from the Goodyear Tire & Rubber Co. (Akron, Ohio, U.S.A.) and Piccolite® from Hercules Chemical Company (Wilmington, Del., U.S.A.). It will be appreciated by those skilled in the art that the particular tackifier selected may vary with the specific asphalt used in order to achieve the desired properties of the final adhesive.

The petroleum oil used herein is the resinous by-product of a lubricating oil tower used in the crude oil refining process. Generally, in the oil refining process, a mixture of volatile hydrocarbons is separated from an asphaltic residue. One subsequent treatment of this residue is to further process it in a lubricating oil tower to yield a light fraction high in heterocyclic hydrocarbons and another residue. This residue is a petroleum oil generally characterized as being relatively soft and high in resins. When used in the instant invention, this petroleum oil is believed to aid in holding the other components together and to impart a tacky characteristic to the sealant. Another desirable characteristic of this resin-containing petroleum oil is its thermal stability. Without being limited as to theory, it is believed that this petroleum oil compatibilizes the system to help prevent phase separation. This petroleum oil is also believed to improve the tackiness of the adhesive at lower temperatures. This material is commercially available as Hub P-Resin from Borcke Associates, Inc. (Great Neck, N.Y., U.S.A.). Hub-P resin is characterized by a viscosity at 210° F. of 2300/2800, a pour point in °F. of +85, an acid number of about 0.15, and contains about 0.10% hard asphalt, 0.15% sulphur and 12.0% carbon residue.

Conventional mixing or blending techniques may be used to make the sealant. Generally, throughout the mix, the temperature is desirably maintained from about 260° F. (126.6° C.) to about 360° F. (182.2° C.). Typically, the adhesive is cooled for packing and then melted for application to a shingle. It may be desirable to circulate and maintain the adhesive at an elevated temperature during processing and application to the shingles to aid in the prevention of phase separation.

Satisfactory results have been obtained when the ingredients of the sealant are present in an amount, in approximate weight percent, of about 25% to about 80% asphalt, about 3% to about 18% elastomer, about 5% to about 25% tackifying resin, and about 10% to about 50% petroleum oil. Preferably, the sealant contains from about 35% to about 60% asphalt, from about 5% to about 12% elastomer, from about 8% to about 20% tackifying resin and from about 15% to about 35% petroleum oil. The most preferred composition is one consisting essentially of, in approximate weight percent, 42% to 48% paving grade asphalt, 10% to 11% elastomer, 17% to 19% tackifying resin and 22% to 28% petroleum oil.

The present invention also provides a roofing shingle employing the above-described adhesive. In the broadest sense of the invention, it encompasses any asphalt-based roofing sheet employing the above-described adhesive, where the roofing sheet is of the type designed to be laid down in courses or layers, with at least a portion of successive sheets overlapping. The invention in the form of an asphalt roofing membrane solves sealing problems by providing good seal at cold temperatures for the overlapping portions of a newly laid down asphalt roofing membrane.

With reference to the drawings, the preferred embodiments, FIG. 1 shows the top surface 11 of a shingle 10 having the tab sealant adhesive 12 applied in the headlap portion 13 of the shingle. The shingle 10 can be any conventional shingle known in the art. Particularly suitable shingles are those made of asphalt reinforced by glass fibers, as exemplified by U.S. Pat. No. 3,332,830, herein incorporated by reference. The adhesive is preferably applied to the headlap portion 13 of the shingle and holds down the overlying tabs 15 of a shingle in the next upper row when installed on a roof. Although FIG. 1 shows the adhesive 12 applied as three discontinuous strips, the adhesive can be applied in any form or configuration which provides an adequate surface area for adhering an overlying shingle. For example, the adhesive may be applied as one continuous strip, or any combination of a number of continuous and/or discontinuous strips of varying dimensions. The sealant may also be placed anywhere on the shingle which would be effective in adhering overlapping shingles, including the bottom side of the shingle.

Figure 3:
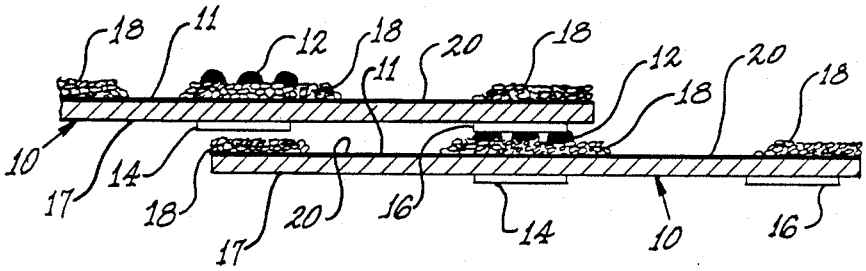
FIG. 3 is a cross-sectional view of two shingles representing their relative positions upon installation.

As shown in FIG. 3, the top surfaces 11 of the shingles are typically covered with granules 18 of crushed rock, and the adhesive 12 is applied over the granules 18.

Figure 2:
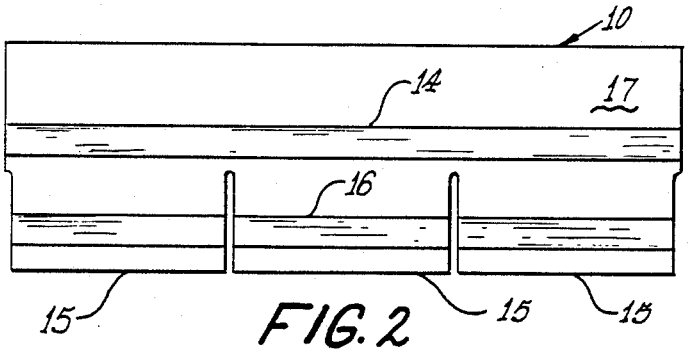
FIG. 2 is a plan view of the bottom side of a shingle with a release surface and a contact surface.
Figure 4:
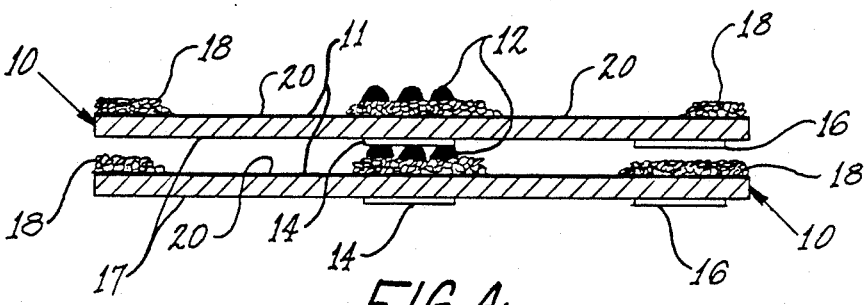
FIG. 4 is a cross-sectional view of two shingles representing their relative positions in a package, before installation.

FIG. 2 shows the bottom surface 17 of a shingle 10 having a strip of release material 14 and a strip of contact surface 16 on the shingle tab 15. Although this location represents the preferred embodiment, the release material 14 and the contact surface 16 may be located on the top surface 11 of a shingle. When the strip of release material 14 is located on the bottom surface 17 of the shingle in a position which corresponds to the position of the strip of tab sealant adhesive 12 on the top surface 11, as shown in FIG. 4, the shingles are prevented from sticking together during packing where they are usually stacked upon each other. The release paper may be removed or left on during installation without any adverse effect on the performance of the shingle.

The release material can be of any material which does not adhere to the sealant so as to prevent the shingles from sticking to each other, particularly before installation. Suitable release materials include paper or polyesters which have to be treated with a non-adhering substance such as silicone or fluorocarbons. Alternatively, the release material may be a liquid or emulsion of silicone- or fluorocarbon-based substances which are applied directly to the shingle by any method, including spraying. Silicone-treated paper is commercially available from James River Corporation (Parchment, Mich., U.S.A.) and a silicone-based emulsion for spray applications is commercially available from Paper-Chem Labs (Rockhill, N.C., U.S.A.).

As shown in FIG. 3, the contact surface 16 works together with the adhesive 12 to form an extra-tight bond between overlapping shingles after installation. The location of the contact surface 16 on the bottom surface 17 of one shingle 10 corresponds to the position of the tab sealant 12 on the top surface 11 of the underlying shingle 10 to form a tight bond between shingles upon installation.

The contact surface 16 may be covered with any material to which the adhesive will adhere, especially in colder temperatures. Suitable materials include polyester, polypropylene, polyethylene, polybutylene, a copolymer of polyethylene and vinyl acetate and may be applied in any form, including strips, films, liquids or emulsions. Preferred is a polyester film commercially available as Mylar ® from E. I. DuPont de Nemours & Co. (Wilmington, Del., U.S.A.).

SPECIFIC EMBODIMENTS

Example 1

The following experiment was conducted to test the bond strength of adhesives after shingles bearing the adhesives were sealed at about 135° F. The bond strength test was conducted by sealing, at 135° F. for 16 hours, two overlapping pieces of roofing shingles bearing various adhesives. Upon cooling, the bond strengths of the adhesives were measured at various temperatures. To measure the bond strengths of the adhesives, an Instron tensile pulling machine, or equivalent apparatus, was used. The machine permits the bottom and top shingle sections to be clamped into place and then pulled while a load cell attached to the upper clamp measures the amount of force required to pull the shingles apart, which is recorded in units of pounds.

Three asphaltic adhesives were tested for bond strength using this method and are identified in Table 1. Adhesives A and B represented formulas of the instant invention while adhesive C was a standard commercially available asphaltic adhesive known as Seal Rite TM, commercially available from Owens-Corning Fiberglas Corporation (Toledo, Ohio, U.S.A.).

TABLE 1

| Adhesive | Content |
|---|---|
| A | asphalt, s.p. 110° F.–120° F.<br>elastomer<br>tackifying resin<br>petroleum oil |
| B | asphalt, s.p. 100° F.–110° F.<br>elastomer<br>tackifying resin<br>petroleum oil |
| C | asphalt<br>approx. 60% propane washed<br>approx. 40% roofing grade |

Figure 5:
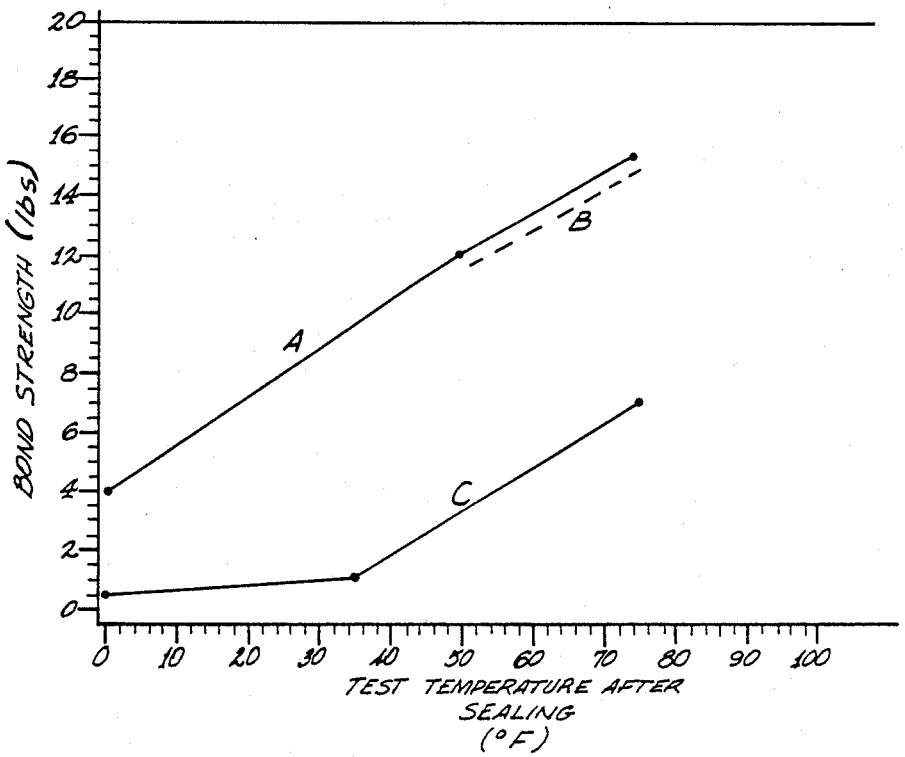
FIG. 5 is a graph of measured values for bond strengths of adhesives.

The results are summarized in FIG. 5, which is a graph depicting the measured bond strengths of adhesives A, B and C represented by lines A, B and C, respectively. Each data point on the graph represents a value which is the average of values obtained from several tests under similar conditions. The bond strength values obtained for adhesive B at 50° F. and 75° F. were the same values obtained for adhesive A at these temperatures. Line B is depicted as a separate dashed line for purposes of clarity in presenting the data.

As can be seen from the test results, the adhesives of the instant invention retained substantially greater bond strength as compared to the standard adhesive at 50° F. when the temperature of the shingles was reduced after sealing at 135° F.

EXAMPLE 2

The above adhesives were also tested according to the Underwriter's Laboratory wind test UL 997 for shingles. To conduct the test, shingles bearing the adhesive were stapled to a plywood deck measuring about 54 in. by 4 ft. The shingles were then sealed in an oven at a temperature of about 135°–140° F. for about 16 hours. After the deck cooled to room temperature, it was placed at a 4 in 12 slope and a 60 mph wind was blown on the deck. It was found that after 2 hours, no tabs lifted on shingles bearing adhesives A and C, while 3 tabs lifted after 45 minutes on shingles bearing adhesive B. Consequently, the inventive adhesive containing the harder asphalt (Adhesive A) provided better resistance than the inventive adhesive with the softer asphalt (Adhesive B) against the winds encountered in the Underwriter's Laboratory wind test.

EXAMPLE 3

An experiment was conducted to test the bond strength of adhesives at the same temperature at which shingles bearing the adhesive were sealed.

To test the adhesive, the shingles were placed together and allowed to adhere at testing temperature for a period of about 16 to 24 hours. At the same temperature, the bond strength of the adhesive was tested using the same apparatus and testing technique described in Example 1. When the testing temperature was below room temperature, i.e., 50° F., the shingles were cooled for 1 hour at 50° F. before sealing them.

The same three adhesives, A and B of the invention and C, a standard adhesive, as in Example 1, were tested.

Figure 6:
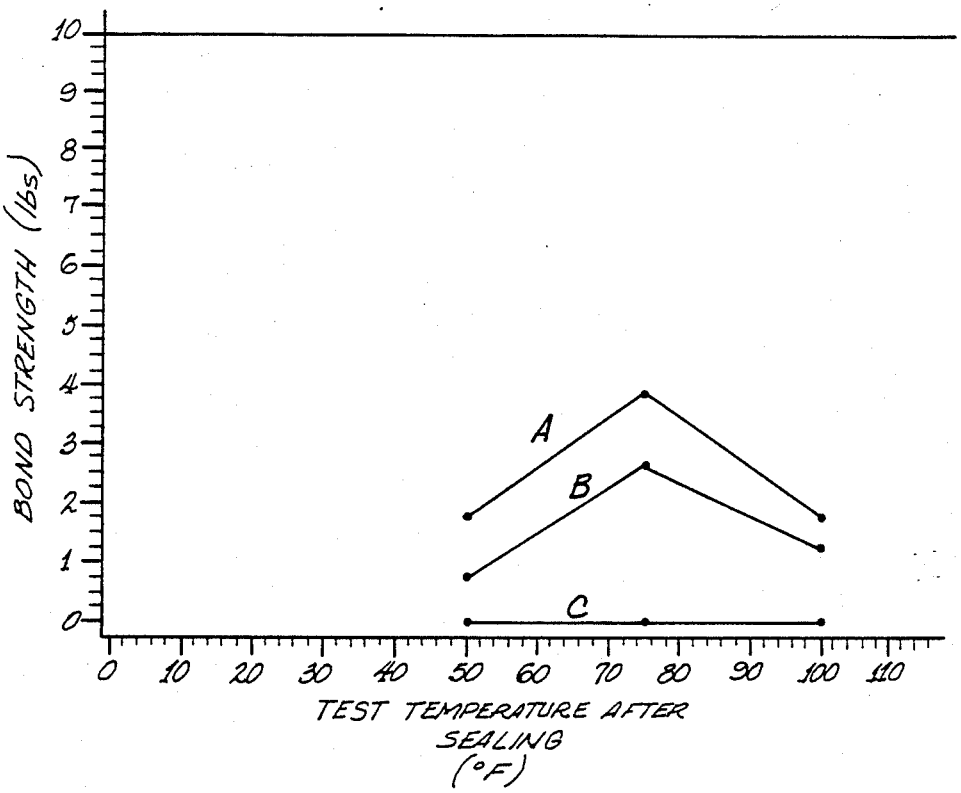
FIG. 6 is a graph of measured values for bond strengths of adhesives.

The results are summarized in FIG. 6 which is a graph depicting the measured bond strengths of adhesives A, B and C, represented by lines A, B and C respectively, according to the procedure described above. Each data point on the graph represents a value which is the average of values obtained from several tests under similar conditions.

As can be seen in FIG. 6, the inventive adhesives, A and B, provided especially good initial cold-temperature bonding strength at 50° F. as compared to the standard adhesive, C, which demonstrated no bond strength at 50° F., 75° F. and 100° F.

Although the invention has been described in terms of specific embodiments of a manner the invention may be practiced, this is by way of illustration only and the invention is not necessarily limited thereto since alternative embodiments and operating techniques will become apparent to those skilled in the art. Accordingly, modifications are contemplated which can be made without departing from the spirit of the described invention.

We claim:

1. An adhesive composition, for retaining adjacent portions of asphalt roofing sheets against windlift at temperatures of about 50° F. and greater, comprising a blend of asphalt, an elastomer containing about 80% triblock styrene-butadiene-styrene copolymer and about 20% diblock styrene-butadiene copolymer, a tackifying resin and a petroleum oil, wherein the blend contains about 25–80% asphalt, a 3–18% elastomer, 5–25% tackifying resin and 10–50% petroleum oil;

wherein the asphalt is characterized by a kinematic viscosity in the range of from about 500 poise±100 to about 250±50 poise at 140° F. (60° C.), a minimum viscosity of from about 110 cs (centistokes) to about 80 centistokes at 275° F. (135° C.), a penetration (ASTM D5 73) of from about 120 to about 300 dmm (decimillimeters) at 77° F. (25° C.), and a ring and ball softening point from about 90° F. to about 130° F.; and wherein the petroleum oil is a resinous by-product of a lubricating oil tower used in the crude oil refining process.

2. An adhesive composition as in claim 1 wherein the blend contains, in approximate weight percent, about 42–48% asphalt, 10–11% elastomer, 17–19% tackifying resin and 22–28% petroleum oil.

3. An adhesive composition as in claim 1 wherein said blend contains, in approximate weight percent, 45.5% asphalt, 10.4% elastomer, 18.3% tackifying resin and 25.8% petroleum oil.

4. An adhesive composition as in claim 1 or 3 wherein said diblock copolymer of said elastomer contains about 31% styrene and about 609% butadiene.

5. An adhesive composition as in claim 1 wherein the blend contains about 35–60% asphalt, 5–12% elastomer, 8–20% tackifying resin and 15–35% petroleum oil.

* * * * *